United States Patent [19]

Hamaguchi

[11] 3,960,306

[45] June 1, 1976

[54] DRIVING MECHANISM FOR ENDLESS SENSITIVE MEMBER

[75] Inventor: Hiroshi Hamaguchi, Sakai, Japan

[73] Assignee: Minolta Camera Kabushiki Kaisha, Osaka, Japan

[22] Filed: Oct. 18, 1974

[21] Appl. No.: 516,245

[30] Foreign Application Priority Data

Oct. 31, 1973 Japan ..... 48-123023

[52] U.S. Cl. ..... 226/96; 226/170; 156/543

[51] Int. Cl.² ..... B65H 17/28

[58] Field of Search ..... 226/96, 170; 156/543; 271/33

[56] References Cited

UNITED STATES PATENTS

| | | | |
|---|---|---|---|
| 3,308,750 | 3/1967 | Voegelin | 226/96 UX |
| 3,355,166 | 11/1967 | Plumb | 226/170 X |
| 3,425,610 | 2/1969 | Stewart | 226/170 X |

*Primary Examiner*—Allen N. Knowles

*Attorney, Agent, or Firm*—Armand G. Guibert; Milton M. Wolson

[57] ABSTRACT

An endless photosensitive member in a photocopy machine is fixedly mounted at each outer edge upon the border of a respective one of a pair of perforated endless belts, the material of the belts having an elasticity which is the same as that of the material of the photosensitive member. The perforated belts are supported upon rollers, at least one of which is driven and has circumferential rows of pins located so as to engage the belt perforations.

7 Claims, 4 Drawing Figures

DRIVING MECHANISM FOR ENDLESS SENSITIVE MEMBER

BACKGROUND OF THE INVENTION

1. Field of the Invention

As described herein, the invention relates generally to electrophotographic machines having endless photosensitive members on which latent images are formed and, more particularly, to improved arrangements for driving the endless photosensitive member.

2. Description of the Prior Art

In electrophotographic copying machines of the type using as the image-retaining element a photosensitive surface on a sheet material, an electrostatic latent image being formed thereon upon exposure to patterned light rays, it is known to mount a photosensitive material in an endless or joined form on a circumferential surface of a conductive supporting drum — made of metal or the like — by an adhesive or other suitable means and exposing the photosensitive material to a light image through a slit while rotating the supporting drum. On the other hand, in another known method which is not limited to the slit exposure as in the first-mentioned exposure method, the photosensitive material is provided in the form of a belt with a wide planar photosensitive surface to allow instantaneous exposure of a full frame.

In this second-mentioned exposure method, however, it is an essential requisite that the exposure area of the photosensitive surface be maintained in a plane in order to allow the desired full frame exposure and that the photosensitive material be maintained under predetermined tension conditions by means of rollers adapted to support and drive the photosensitive material while precluding slipping movement or deviation of the photosensitive material on the driving rollers thereby ensuring accurate rotational movement of the photosensitive material with the driving rollers. In addition, the photosensitive body is required to maintain its smooth plane surface in the exposure area during repeated electrostatic image forming operations. In general, the photosensitive body is required to withstand 5000 to 10,000 cycles of copying operation.

Where a hard or relatively rigid metallic material is used for the base of the photosensitive body in order to satisfy the above-mentioned requirements, relatively large forces are necessitated in extending and tensioning the photosensitive body to obtain a plane surface. The photosensitive surface of that member (for example, a vapor-deposited organic photoconductive surface layer) is then subject to cracking due to repeated bending on and along the curved surfaces of the driving and supporting rollers. This is mainly attributable to the rigidity of the base material of the photosensitive body which hardly fit the curved surfaces of the driving rollers and causes cracks to form in the photosensitive surface — the organic photoconductive layer say — as a result of the physical bending movement. Especially where the driving and support rollers are required to have small diameters for the sake of compactness of the duplicator machine, such cracking occurs to a greater degree which is not tolerable in practical applications.

For these reasons, it is the general practice with the belt-type photosensitive body to employ a flexible material — such as, for example, a polyethylene terephthalate film — as the base of the photosensitive body. The known photosensitive body having a base of a flexible material is usually held between driving belts disposed on opposite sides of the photosensitive body and all being secured to each other by means of a transverse metal fitting at a suitable position on the circumference of the belts so that the photosensitive body and the driving belts are driven at the same speed. Difficulties are encountered, however, with such known construction. Firstly, it is difficult to apply sufficient tension on the photosensitive body due to differences in elasticity between the photosensitive body and the driving belts, that is to say, it is difficult to maintain the photosensitive body in a plane state as required for full frame instantaneous exposure. The difficulty becomes more pronounced with a metal belt.

Secondly, since the wide photosensitive body is in contact with the driving rollers over its entire width, it is difficult to control uniformly the tensions in the opposite longitudinal edge portions of the photosensitive body. Further, the difference in tension between these portions becomes prohibitively large during operation over a long period of time, thus driving the photosensitive body in a biased state. As a result, the photosensitive body loses its flatness and is deviated from a correct position, i.e., from the exposure position. This tendency of the wide photosensitive body to deviate is very strong so that the belts do not function as a guide for the photosensitive body at all, this difficulty being present even in the case where the belts are formed of metal and provided with perforations to ensure secure drive by a sprocket.

Thirdly, the metal fitting which fixedly connects the photosensitive body and the belts generally projects above the photosensitive surface so that it scratches off the powdery toner cascaded on the surface of a developing drum located at a predetermined distance from the photosensitive surface in the toner developing station, causing irregularities in development. Furthermore, projection in one particular locality gives rise to overcharging which leads to contamination of various portions due to deposition of the toner in a large amount.

Where the photosensitive body is directly provided with perforations along the longitudinal edges thereof to allow drive by a sprocket, the drive system has a simplified construction but involves positional deviation of the photosensitive body, which might destroy the perforations and shorten the life of the photosensitive body per se.

On the other hand, for the purpose of overcoming the aforementioned drawbacks, there has been proposed a drive system where instead of providing the photosensitive body in the endless form mentioned hereinbefore, it is provided in the form of a number of discrete photosensitive sheets suspended between a pair of parallel drive belts. With this drive system, however, there exists a number of large gaps between the respective photosensitive sheets in series in the circumferential direction, so that toner is allowed to get inwardly of the photosensitive body through the gaps to a position between the surface of the roller and the rear surface of the photosensitive body, forming a projection at a particular locality of the photosensitive body toward the photosensitive surface thereof since the photosensitive body is held in a tensioned state, and causing thereat an overcharging which would contaminate and make unclear the duplicated image.

The present invention is therefore directed to an apparatus which overcomes the aforementioned difficulties and defects in driving a wide endless photosensitive member having a base of a flexible material.

SUMMARY OF THE INVENTION

The invention provides an apparatus for driving an endless photosensitive member made of a wide sheet material having a photosensitized surface, said material having a discrete elasticity, comprising a pair of endless belts mounted on a number of parallel-axis rollers and having adjacent borders spaced less than the width of said sheet material, said belts being of a material having an elasticity substantially equal to said discrete elasticity, and at least one of the belts having non-slip means engaging a driven one of the rollers for movement therewith, the longitudinal edges of the photosensitive member being mounted along the adjacent borders of the circumference of the belts in superposed relation therewith, the photosensitive material being fixed to each belt on its circumference and being thereby driven at the same time with said belts.

According to one feature of the present invention, the photosensitive body in an endless form is superposed on and driven by belts being the same elasticity as the base material of the body, rendering it not only easy to apply proper tension to the photosensitive body, but also to retain it in the flat state throughout one portion of its path of motion because of the greater uniformity of the tension at the opposite edges of the photosensitive body.

As another feature of the present invention, the photosensitive body is connected to each belt at just one circumferential position, with the result that the driving belts are permitted to move laterally at positions other than the point of attachment without effect upon the flatness of the photosensitive body and limited lateral deviation thereof. As a result, the alignment of the perforations in each belt can be of lower precision than that required in perforated photosensitive bodies according to the prior art.

Other features of the invention will become apparent from the description and drawings which follow.

BRIEF DESCRIPTION OF THE DRAWING

The invention will now be described by way of example in reference to the accompanying drawings, wherein.

Figure 1:
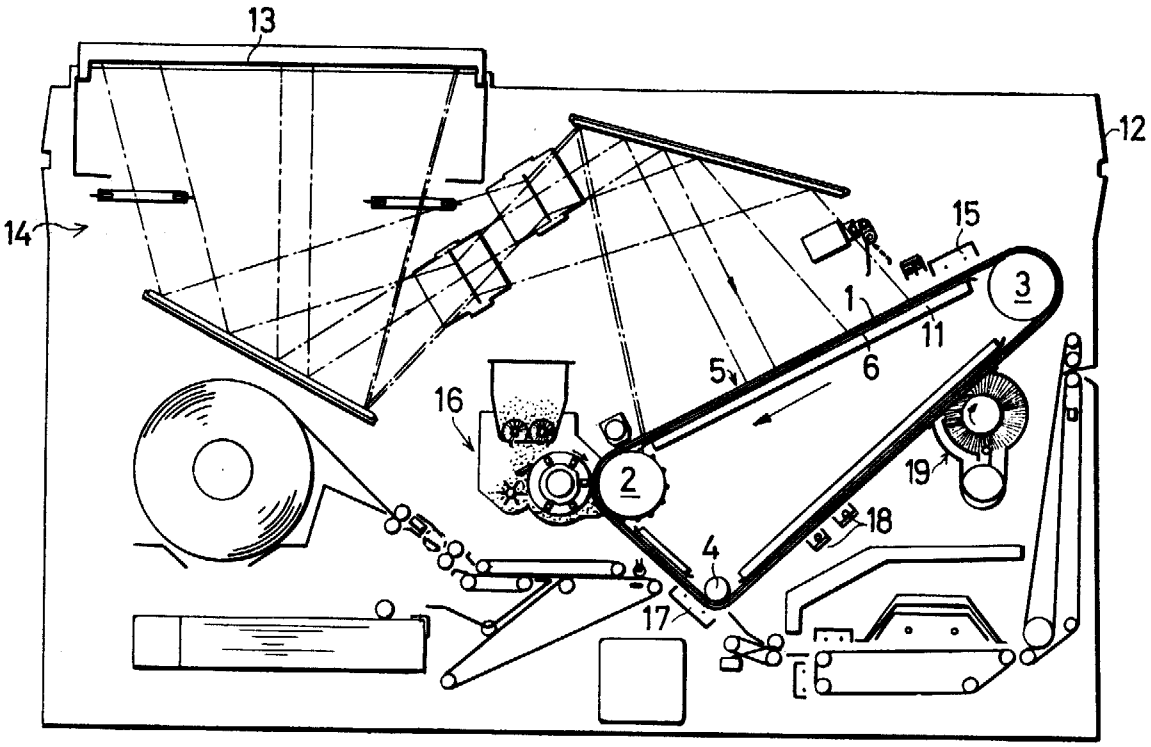
FIG. 1 is a side view showing the inner mechanisms of an electrographic duplicator machine employing the drive apparatus according to the present invention.

In the drawings, the reference numeral 1 designates a photosensitive body, 6 a belt for driving the photosensitive body, 7 a perforation in a belt 6, and 9 a connecting tape having an adhesive agent on both faces thereof.

DESCRIPTION OF THE PREFERRED EMBODIMENT

Referring now to the embodiment of the invention shown in the drawings, particularly FIG. 1, the reference numeral 1 designates a wide endless photosensitive member or body having a base of a flexible material such as a polyethylene terephthalate film, a conductive metal layer being laminated on the surface of this base, and an organic photoconductive layer being formed on the conductive layer by vapor deposition. The photosensitive body 1 as a whole has a thickness less than 0.1 mm, inclusive. Indicated at 2, 3 and 4 are rollers for driving the photosensitive body 1 and supporting it in a tensioned state to impart a flatness at an exposure position 5. Roller 2 is a driving roller and the others, 3 and 4, are tension rollers.

Applied around rollers 2, 3 and 4 are a pair of belts 6 which are preferably of the same material as the base of the photosensitive body 1, but may be of any material having substantially the same elasticity as that of the base material of body 1. The belts 6 are disposed in parallel spaced relation with each other. The opposite longitudinal edge portions of photosensitive body 1 are superposed on the respective adjacent longitudinal borders on the circumference of the belts 6. The belts 6 and the photosensitive body 1 are fixedly secured to each other at a suitable position on the superposed circumferences thereof by means of an adhesive 9 or the like. Each belt 6 is driven by a respective sprocket 8 which meshes with perforations 7 formed in the belts 6. As a result, photosensitive body 1 — which is partially superposed on the belts 6 — is driven along with the belts 6 upon movement thereof.

Figure 3:
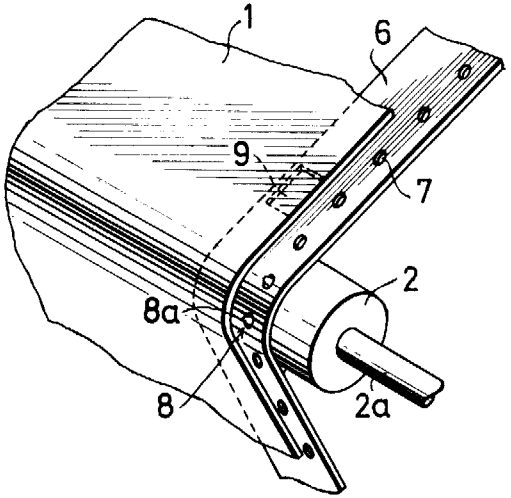
FIG. 3 is a fragmentary perspective view showing part of the embodiment on an enlarged scale.
Figure 4:
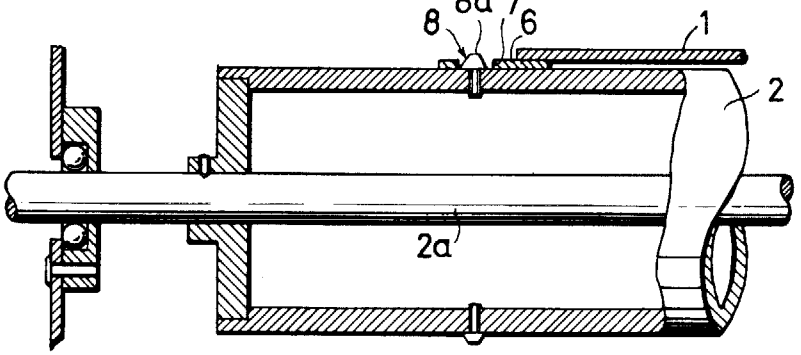
FIG. 4 is a fragmentary sectional view of the drive roller, photosensitive body.
Figure 2:
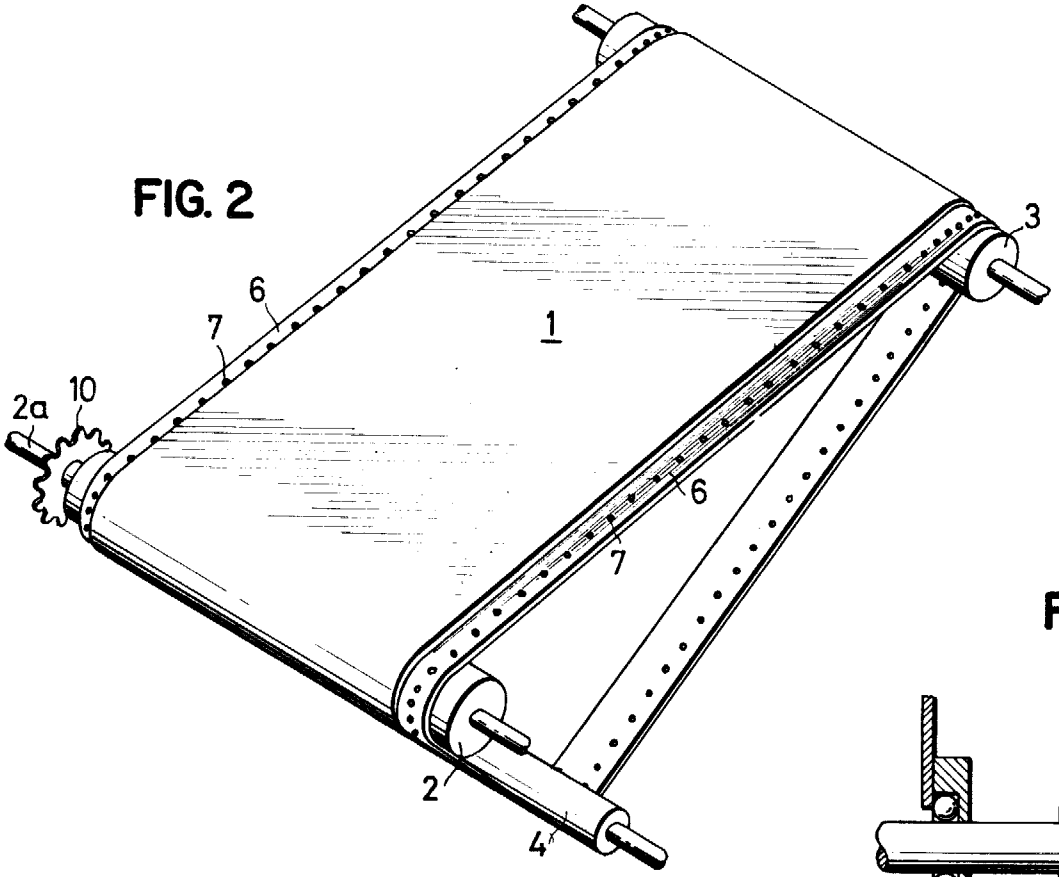
FIG. 2 is a perspective view of a preferred embodiment of the invention.

The sprockets 8 which drive the respective belts 6 are formed, for example, by fastening (in known fashion, e.g., threading) the teeth **8*a* of the sprockets 8 on the circumference of roller 2 at opposite ends thereof. In this instance, no sprocket is provided on the other rollers 3 and 4 to allow positional deviation of the belts 6. Interconnection of belts 6 and photosensitive body 1 is achieved, for example, by means of an adhesive tape 9 (see FIG. 3) supplied with an adhesive agent on both faces thereof. Driving roller 2 is rotated by a suitable power source (not shown, but known) through sprocket 10 mounted on rotating shaft 2*a* of roller 2. As mentioned previously, photosensitive body 1 has a conductive layer, not shown, along its longitudinal edge and is grounded therethrough in conjunction with any of the rollers 2, 3 or 4**, as is known.

Referring to FIG. 1, there is shown generally an electrophotographic duplicator machine 12 which has incorporated therein the photosensitive body 1 and its driving mechanism, a fixed original mounting platen 13, an assembly 14 consisting of an optical system and a lamp for forming an image of the original mounted on platen 13 and projecting the image onto photosensitive body 1 at exposure position 5, a charge device 15 for imparting an electrostatic photosensitivity to the photosensitive body 1 immediately before the exposure position 5, a developer unit 16 for developing the electrostatic latent image formed on photosensitive body 1 during the exposure, a charge device 17 for transferring the developed image from photosensitive body 1 to a copying sheet (not shown, but known) fed in intimate contact with the photosensitive body 1, a discharge device 18, and a cleaner 19 for removing residual toner from the surface of photosensitive body 1. Reference numeral 11 indicates a suction box provided on the back side of photosensitive body 1 for aid in maintaining photosensitive body 1 in the desired flat or planar state.

Photosensitive body 1 is continuously or intermittently driven and repeats the duplicating operation in cooperation with various components described above and located around the circumference thereof. The drive of the photosensitive body 1 is attained by impelling the paired belts 6 by way of the driven roller 2, since photosensitive body 1 is partially superposed on belts 6 so as to follow the movement of the latter. In this respect, photosensitive body 1 is driven securely without slipping movement because it is fixed to each belt 6 at one circumferential position by an adhesive tape 9.

Upon being driven, photosensitive body 1 and the belts 6 experience a positional deviation between rollers 3 and 4 which have no sprockets and driving roller 2 which is provided with sprockets 8. Though it is large in width, photosensitive body 1 does not directly contact any one of the rollers 2, 3 and 4 and is driven only by opposite longitudinal edge portions supported by and superposed on the adjacent longitudinal borders of the paired belts 6. Since photosensitive body 1 and belts 6 have the same elasticity, it is easy to apply a sufficient tension thereon and to control the tensions in the opposite longitudinal edge portions under balanced conditions either by mechanical or manual operation. Therefore, the unbalance in tension can be held to a minimum during the driving operation and the deviation of photosensitive body 1 is far smaller than with the prior known counterpart which is in contact with the roller over the entire width of the photosensitive body. On the other hand, though the paired belts 6 are in contact with the rollers over their entire widths, they experience only a small force of deviation as they are small in width.

As gathered from the foregoing description, it will be understood that there occurs only a small deviation in the location of the photosensitive body 1 due to an unbalance in tension or in friction in the transverse direction of photosensitive body 1 and belts 6 during the driving operation thereof.

Further, even if a slight deviation occurs, the belts 6 are allowed to displace freely widthwise between roller 2 with its driving sprockets 8 and roller 3 which has no driving sprockets, rectifying their postures by engagement of perforations 7 with the teeth 8*a* of the sprockets 8 in the right direction. Thus, the perforations 7 of the belts 6 are free from breakage and the belts 6 are forced to flex to take a correct path, so that the photosensitive body 1 which is partially superposed on the belts 6 also corrects its path of travel, following the movement of the latter to preclude further positional deviations thereof.

In this connection, since the belts 6 are preferably connected to photosensitive body 1 only at one point, their positional deviations and the forced flexing movement produce almost no adverse effects on photosensitive body 1. For example, the previously-mentioned conventional photosensitive body which has perforations directly formed therein generally endures duplication of 4000 to 5000 copies with its tension adjusted normally and endures duplication of about 10,000 copies with its tension adjusted repeatedly to preclude flexing movements. In contrast, the photosensitive body according to the present invention endures duplication of 40,000 to 50,000 copies with its tension adjusted normally and thus is extremely improved in durability.

The above description of an improved driving mechanism for an endless photosensitive member comprises a photosensitive body 1 made of wide sheet material in an endless form with opposite longitudinal edges superposed on and affixed at one circumferential position by an adhesive member 9 to the adjacent longitudinal borders of a pair of endless belts 6 trained around parallel-axis rollers, such that these borders are spaced less than the width of the sheet material. At least one of the belts 6 is provided with perforations 7 which engage teeth 8*a* of a sprocket 8 formed around the circumference of a driven one of the rollers 2 such that the belts 6 and the body 1 affixed thereto are conjointly moved upon rotation of the driven roller 2, and the material of body 1 and belts 6 is of substantially identical elasticity.

From the foregoing, it will be evident to those skilled in the art, that according to the present invention, there is provided a drive mechanism for a photosensitive body in an endless form, which mechanism is completely immune to the drawbacks inherent in that for the discontinuous photosensitive body mentioned hereinbefore and since the photosensitive body has the same elasticity as the belts on which it is superposed and by which it is driven, it is easy to apply sufficient tension on the photosensitive body. No slip occurs between the photosensitive body and the driving belts as they are securely connected to each other. Furthermore, the photosensitive body can be easily retained in a flat state at the exposure position and adjustment of the tension of the photosensitive body can be facilitated to a considerable degree. As the photosensitive body is connected to the belts at a circumferential position and driven in superposed relation therewith, the deviation of the photosensitive body can be suppressed to a small limited range. The connection of the photosensitive body with the driving belts forms a localized projection on the photosensitive surface, but it is located outside the required exposure width and cannot possibly cause irregularities of development by scratching off the developing toner.

Moreover, according to the invention, the photosensitive body has no perforations and allows easy adjustment of its tension at a suitable level so that there is no possibility of the photosensitive body being subjected to accelerated wear due to application of excessive tension caused by large positional deviations. In addition, the base of the photosensitive body is formed from a flexible material which fits on the surface of the rollers. The photosensitive body is therefore not required to have a high strength as in the case where perforations are formed directly in the photosensitive body and may be formed in a small thickness to ensure good fit on the roller surfaces and sufficient strength to prevent dislodgement of the photosensitive layer. The photosensitive body has an excellent durability and can handle a considerably increased number of copies, with reduced noise as compared to the prior art using a metal belt.

Since the driving belts are allowed to move sideways, the rows of perforations formed in the opposing two belts are not necessarily required to be parallel to each other. The perforations can therefore be formed by a simple small-sized tool without the high precision often required in forming perforations along the opposite longitudinal edges of the photosensitive body by means of a large machining apparatus. Furthermore, the operation of setting the photosensitive body on the respective rollers is also facilitated to great advantage.

It should be understood that the embodiment described above is merely illustrative of the principles of the invention. Many modifications may, of course, be made thereto without departure from the spirit and scope of the invention as set forth in the following claims.

What is claimed is:

1. In an electrophotographic duplicator having an endless photosensitive member made of a wide sheet material with a photosensitized surface, said sheet material having a discrete elasticity, an improved driving mechanism for the photosensitive member comprising a pair of endless belts mounted on a plurality of parallel-axis rollers with adjacent borders thereof spaced less than the width of said sheet material, said belts being of a material having an elasticity substantially equal to said discrete elasticity and at least one of the belts having non-slip means engaging a driven one of the rollers for movement therewith, the longitudinal edges of the photosensitive member being mounted along said adjacent borders of the belts in superposed relation therewith and means fixing said photosensitive material to each said belt and being thereby driven conjointly with said belts.

2. The drive mechanism defined in claim 1, wherein said driven roller-engaging means comprises sprocket means on said driven one of the rollers and perforations in said at least one belt adapted to cooperate with said sprocket means.

3. The drive mechanism defined in claim 2, wherein said means fixing said member to said belts comprises an adhesive member applied between said superposed edges and borders at one discrete position on the circumference of each said belt.

4. The drive mechanism defined in claim 1, wherein both said belts engage said driven one of the rollers.

5. The drive mechanism defined in claim 4, wherein said driven roller engaging means comprises a pair of spaced sprockets on said driven roller and perforations in each of said pair of belts adapted to cooperate with a respective one of said spaced sprockets.

6. The drive mechanism defined in claim 5, wherein said means fixing said member to said belts comprises an adhesive member applied between said superposed edges and borders at one discrete position on the circumference of each said belt.

7. The drive mechanism defined in claim 6, wherein said adhesive member comprises a double-faced tape having an adhesive agent on each face.

* * * * *